United States Patent [19]

Winslow et al.

[11] 4,260,677

[45] Apr. 7, 1981

[54] THERMOGRAPHIC AND PHOTOTHERMOGRAPHIC MATERIALS HAVING SILVER SALT COMPLEXES THEREIN

[75] Inventors: John M. Winslow; Donald H. Klosterboer, both of Saint Paul, Minn.

[73] Assignee: Minnesota Mining and Manufacturing Company, St. Paul, Minn.

[21] Appl. No.: 666,350

[22] Filed: Mar. 12, 1976

Related U.S. Application Data

[63] Continuation-in-part of Ser. No. 659,839, Feb. 20, 1976, abandoned, which is a continuation-in-part of Ser. No. 558,839, Mar. 17, 1975, abandoned.

[51] Int. Cl.[3] ..... G03C 1/02

[52] U.S. Cl. ..... 430/618; 430/619

[58] Field of Search ..... 96/114.1

[56] References Cited

U.S. PATENT DOCUMENTS

| | | | |
|---|---|---|---|
| 3,679,422 | 7/1972 | de Mauriac et al. | 96/114.1 |
| 3,767,414 | 10/1973 | Huffman et al. | 96/114.1 |
| 3,847,612 | 11/1974 | Winslow | 96/114.1 |
| 3,933,508 | 1/1976 | Ohkubo et al. | 96/114.1 |
| 3,935,012 | 1/1976 | Eian | 96/114.1 |
| 3,957,493 | 5/1976 | Masuda et al. | 96/114.1 |

*Primary Examiner*—Mary F. Downey

*Attorney, Agent, or Firm*—Cruzan Alexander; Donald M. Sell; Mark A. Litman

[57] ABSTRACT

Thermographic and photothermographic materials are provided by using organic or inorganic silver salts complexed with coordinating compounds having a gross stability constant between 4.50 and 10.00. When the complexed silver salt is in catalytic proximity to photosensitive silver halides, photothermographic elements are produced.

14 Claims, No Drawings

THERMOGRAPHIC AND PHOTOTHERMOGRAPHIC MATERIALS HAVING SILVER SALT COMPLEXES THEREIN

This application is a continuation-in-part of U.S. Ser. No. 659,839, filed Feb. 20, 1976, now abandoned, which is in turn a continuation-in-part of application Ser. No. 558,839, filed Mar. 17, 1975 now abandoned.

Photothermographic image recording systems, as they are presently used, are imaged and developed by light exposure and subsequent heating. Thermographic sheets are imaged and developed by heat exposure. The light exposure ordinarily will generate silver atoms within the photothermographic system which are catalytic to the reduction of organic salts of silver; the subsequent heat treatment will effect the deposition of silver from the salts in catalytic proximity to the catalytic material. The most successful photothermographic process to date is described and claimed in U.S. Pat. No. 3,457,075, issued July 22, 1969. In this patent, organic silver salts (e.g., silver behenate and silver stearate) are treated with halide ions to generate silver halide in catalytic proximity to the surface of the salt. When light-struck, these areas of silver halide are believed to generate latent images of silver which are autocatalytic for further deposition of silver from the organic silver salts. Upon subsequent heating (with reducing agents present in the imaging layer) a negative image is generated. The technology of this patent was a significant advance over the art, in that a considerable increase in speed was obtained, approaching that of early silver halide photographic systems.

It has been found, according to the practice of the present invention, that a novel class of silver-containing materials may be used in thermographic or photothermographic systems.

It has been further found that use of this novel class of silver-containing materials is able to significantly simplify the manufacturing process.

It has also been found in the practice of the present invention that the manufacture of thermographic or photothermographic sheets is more readily controlled.

It has further been found in the practice of this invention that silver salt complexes, wherein the ligand has a certain limited range of affinity for positive silver ions, provide a thermographic silver ion source without a speed loss and with improved shelf-life.

Generally, the present invention contemplates the substitution of silver complexes for silver salts in photothermographic sheets. In order for a clear understanding of the nature of this invention some background in coordination chemistry is desirable.

A complex is formed between at least two materials when each of those materials by itself is capable of existing under chemically significant circumstances (e.g., in solution), the complex contains each of those at least two materials without chemical modification, and the complex is isolable. To illustrate this, a pyridine and silver nitrate complex will be discussed. Pyridine

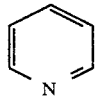

has a high electron density in the vicinity of the ring nitrogen atom. This high electron density enables the molecule to share its electron density with areas of positive charge. In solution with silver nitrate, the sharing is believed to occur as

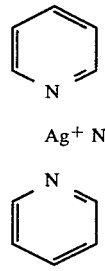

This structure is isolable from solution, and it can be seen that there is no chemical modification of the complexing pyridine ligand (as by loss of a hydrogen atom or opening of a bond). As long as a significant amount of complex is formed in the combination of a silver salt and a coordination compound (alternatively called complexing agent or sequestering agent) having a certain range of affinity for silver ions, the combination of silver salt and coordination compound is useful in the practice of this invention. This description is necessary, because as the extreme ranges of allowable affinity are approached, certain complexing agents will form both salts and complexes. It is required, however, that at least a significant amount of a complex be formed (i.e., an amount from which the complex is recoverable). In the use of imidazole for the complexing agent, for example, both silver salt (A) and silver complex (B) are obtained from solution.

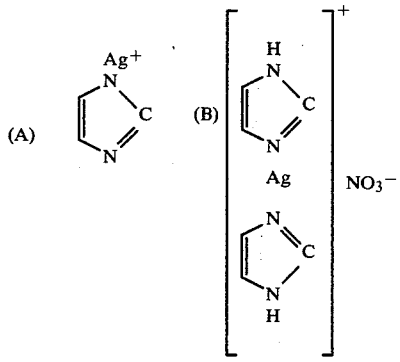

As long as a significant amount of the complex is formed, however, the product is useful in the practice of the present invention, as the complex is still isolable from the salt.

The strength of coordination compounds depends upon the specific ions or atoms having charge density with which those compounds are complexing. In the practice of this invention, all measurements or values will be in relationship to $Ag^+$. The following equation (Irving and Rosotti equation) expresses the relationship of parameters in regard to the strength of complexes (e.g., their stability constants):

$$\frac{\bar{n}}{(\bar{n}-1)(L)} = \frac{(2-\bar{n})(L)}{(n-1)} K_1K_2 - K_1 \qquad \text{Equation I}$$

Where n is the average number of ligand molecules bound per silver atom,

L is the free ligand concentration, and $K_1$ is the stability constant of the first ligand attached to an Ag ion $K_2$ is the stability constant of the second ligand attached to that ion.

The procedure generally used to determine the stability constants is as follows:

Solutions of 0.1 M $AgNO_3$, 0.1 M KOH, 0.625 M $KNO_3$, 1 M $HNO_3$ and 0.025 M ligand are made as standards for each determination. 2.5 millimoles of ligand are dissolved in 80 ml of the $KNO_3$ solution and 3 ml of the $HNO_3$ solution is added to form the ligand nitrate salt. This solution is diluted to 100 ml with additional 0.625 M $KNO_3$ solution yielding a 0.025 M ligand solution.

A 15 ml portion of the prepared ligand solution is added to a breaker with 15 ml of 0.625 M $KNO_3$ solution and 10 ml of water. This solution is titrated with the 0.1 M KOH solution, recording the pH at 0.5 ml increments. With these values the stability constants ($K_1$ and $K_2$) can be determined from a plot of $\bar{n}/(\bar{n}-1)$ (L) vs. $(2-\bar{n})$ (L)/$(\bar{n}-L)$ wherein the slope yields $K_1$ $K_2$ and the intercept gives a value for $K-1$. See Bjerrum, "Metal Amine Formation in Aqueous Solution", P. Haase and Son, Copenhagen, 1957. Upon determination of $K_1$ and $K_2$ the gross or cumulative stability constant ($\beta$) is determined as the sum of Log $K_1$ and Log $K_2$.

In the practice of this invention, coordinating compounds having a gross stability constant between 4.5 and 10.0 are found to provide complexes useful in photothermographic constructions.

The reason why the $\beta$ values are important to the practice of this invention can be readily understood. The complexes of this invention must provide a source of silver metal for the image and therefore must be reduceible. With $\beta$ values below 4.50, the complex is too ready a supply of silver; that is, it has poor shelf life and is less light stable than stronger complexes. When the reducing agent (developer) is heated in proximity to those complexes with $\beta$ values of less than 4.50, they are likely to be reduced even if they have not been imagewise exposed. The complex clearly should have $\beta$ values of at least 4.50 to work most satisfactorily. Examples of such complexes with a $\beta$ value of less than 4.50 are the weak $\pi$ bonding complexes such as ethylene or benzene where silver ions are bonded to $\pi$ electrons. The limit on the higher complexing strength is similar in nature. If too strong a complex is formed, heat development will not readily be accomplished, and a stronger reducing force than that which can be provided by included developer must be used. If the complex is too strong to be readily reduced ($\beta > 10.00$), no image will form because no silver metal will be available for image formation.

One of the most important advantages in the practice of this invention is the ease of coatability of the silver complex containing emulsion. In order to gain this benefit, at least 90% of the silver within the layer which supplies image silver, excluding the photographic silver halide in the case of photothermographic materials, ought to be in the form of a complex when coated. It is more preferred that 95% of the silver be in complex form, and most preferred that substantially all silver be complexed (excluding the small amount which is in the form of photographic silver halide for light sensitivity).

Essentially two general types of recording media are contemplated in the practice of the present invention:

(1) A thermographic recording medium comprising at least one layer comprising a binder, a reducing agent, and at least one silver salt complexed by at least one coordinating compound having a gross stability constant between 4.50 and 10.00 wherein at least 90% of all silver salt within said layer is in the form of a silver salt complex with said at least one coordinating compound.

(2) A photothermographic recording medium comprising at least one layer comprising a binder, a reducing agent, and at least one silver salt complexed by at least one coordinating compound having a gross stability constant between 4.50 and 10.00, wherein at least 50% of all silver in said layer is in the form of a silver salt complex, wherein at least 90% of all silver salts (excluding silver halide) is in the form of a silver salt complex with said at least one coordinating compound, and wherein sufficient silver halide is present in catalytic proximity to the complexed silver salt.

The minimum percentage of total silver in the recording medium which must be in the form of photographic silver halide to render the medium photothermographic is about 0.25 molar percent. This small percentage of silver halide would require intense illumination to effect a thermographically developable image, but this small amount does function in the practice of the present invention. This lower limit on silver halide in photothermograhic constructions might be useful for such constructions as day-light handleable dry silver sheet materials. All silver molar percentages are based on total silver in the recording medium.

There is no functional upper limit to the molar percentage of silver halide which may be used in the practice of this invention, but as a matter of general practice a limit of 50 molar percent silver halide is reasonable. A generally preferred range would be to have about 1 to 15% of the total silver in the recording medium in the form of silver halide.

The silver halide may be placed in catalytic proximity to the complexed silver salt by any available method. The three generally accepted procedures are physical admixture of silver halide and the silver source, halidization of the Ag source (e.g., U.S. Pat. No. 3,457,075), or addition of the thermographic silver source to preformed silver halide grains (e.g., U.S. Pat. No. 3,839,049).

Many alternative procedures should be apparent to the ordinarily skilled artisan, alternatives which do not change the nature of the present invention. For example, complexed silver salt may be preformed, isolated, then added to binder compositions (as in Example 2) or the complex may be formed, in situ, within the binder (as in Example). Both of these procedures may be practiced satisfactorily, however, different precautions must be taken in each case. In the use of acidic resins and basic nitrogen coordinating compounds, care should be used (by way of excess complex, for example) because the complexing agent may form an adduct with the polymer.

Any silver salt may be used to make up the residual amounts of silver source to 100% in the photothermographic or thermographic media. Once the reduction of the silver complex has begun, other silver salt present will be catalyzed to the reduction of the silver ion to silver metal for the image. Although substantial amounts of silver halide may be in catalytic proximity (sufficient physical contact or other physically intimate relationship to catalyze reduction of the complex to silver after the silver halide has been sensitized to development by the incidence of light) to the silver salt complex, there should not be more than about 10 mole percent total silver salt which is other than complexed silver or uncomplexed silver halide in order to obtain one of the most significant benefits of the present system, its ease of coatability. All percentages are molar percentages unless otherwise stated.

Any silver salt, organic or inorganic, may function as described in the practice of the present invention if an isolable complex can be formed between the salt and the presently described complexing agents. Even such insoluble silver salts such as silver bromide or iodide could be used, although with great difficulty. These salts are minimally soluble (e.g., pK values substantially less than $10^{-10}$ in conventional solvents) and therefore there is difficulty in forming significant amounts of the complex because so little salt is available in solution. Among the more common silver salts useful in the present invention are silver salts of chlorine, behenate, nitrate, nitrite, acetate, carbonate, citrate, phthalate, borate, sulfate, stearate, oxylate, benzoate, phosphate, 2-ethylhexanoate, arsenate, etc.

The following table shows values of K, $K_2$ and $\beta$ for certain known coordinating compounds.

| Ligand | Log $K_1$ | Log $K_2$ | $\beta$ |
|---|---|---|---|
| $(NH_2)_2$ CS(thiourea) | — | — | $\beta_3 = 13.0$ |
| p-$MeOC_6H_4SO_3$ | −.1 | — | — |
| p-$EtSC_6H_4SO_3$ | 2.62 | 1.68 | $\beta_4 = 6.5$ |
| p-$C_6H_5S$ $C_6H_4SO_3$ | 1.67 | 1.34 | $\beta_4 = 5.7$ |
| 2-aminoethyl methyl sulfide | 4.17 | 2.71 | — |
| p-$C_6H_5Se$ $C_6H_4SO_3$ | 2.63 | 2.26 | $\beta_4 = 8.7$ |
| m-$H_2N$ $C_6H_4SO_3$ | 1.23 | 0.90 | $\beta_4 = 2.4$ |
| m-$(C_6H_5)_2P$ $C_6H_4SO_3$ | 8.15 | 5.95 | $\beta_3 = 20$ |
| As $(C_6H_4SO_3^-\text{-m})_3$ | 5.36 | — | — |
| 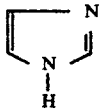 (Imidazole) | 3.1 | 3.9 | $\beta_2 = 7.0$ |
| 2,4-dimethylimidazole | 3.4 | 4.1 | $\beta_2 = 7.5$ |
| 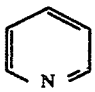 (pyridine) | 2.0 | 2.2 | $\beta_2 = 4.2$ |
| 2-methyl pyridine | 2.3 | 2.4 | $\beta_2 = 4.7$ |
| 2,4-dimethyl pyridine | 2.5 | 2.4 | $\beta_2 = 4.9$ |
| ammonia | 3.2 | 3.8 | $\beta_2 = 7.0$ |
| ethyl amine | 3.3 | 3.8 | $\beta_2 = 7.1$ |
| 2-aminoethanol (ethanolamine) | 3.1 | 3.6 | $\beta_2 = 6.7$ |
| 2-aminoethyl phosphate | 3.7 | 3.1 | $\beta_2 = 6.8$ |
| 2-aminoethyl sulfate | 3.3 | 3.3 | $\beta_2 = 6.6$ |

It is to be noted that aminocarboxylic acid coordinating compounds have not been listed in the above Table giving values for $\beta$. It has been found that such compounds do not in fact complex with silver in solution except in the most extreme concentrations of silver, which would not be practical for obtaining a complex for thermographic or photothermographic constructions. As noted in *Inorganic Chemistry*, vol. 4, No. 5, May, 1965, pp. 767–769, silver ions form carboxylic acid salts with aminoacetic acid compounds. That is, instead of the silver ion being coordinated with the nitrogen atom of a compound such as ethylenediamine-tetraacetic acid, the silver ion instead satisfies the electron requirements of the carboxylic acid group by forming a salt, $COO^-Ag^+$. Such materials would therefore be included within the compositons of U.S. Pat. No. 3,457,075. In any event, because of this salt being formed instead of a coordination complex, aminoacetic acid compounds are not truly complexing agents for silver salts in the practice of this invention and are excluded from the scope of the present invention.

A preferred class of coordinating compounds are those materials containing an imidazole. The class of compounds known as imidazoles are generically preferred, and any material, including polymers having an imidazole capable of sequestering silver ions are useful.

It has been found that those coordinating materials which exhibit a $\beta$ for $Ag^+$ of between 4.50 and 10.00 provide complexes with silver salts (organic or inorganic) which are useful in photothermographic or thermographic systems.

The silver salt complexes of this invention may be advantageously used in various types of dry photographic constructions.

When the complexes are contained in a binder with a reducing or developing agent and there is no light sensitive salt which generates nuclei catalytic to the reduction of the complex, essentially only thermographic sheets are produced. That is, the sheets are both imaged and developed by the application of image patterns of heat to the sheet.

In constructing photothermographic sheets, light sensitive salts generating nuclei catalytic to the reduction of the complex must be in catalytic proximity to the complex. A material is in catalytic proximity to the complex if its physical relationship within the structure is sufficient to provide catalysis towards reduction of the silver of the complex. Catalytic proximity exists at any time that the complex and light sensitive salt are randomly or homogeneously dispersed within the same layer, when parts of the silver salt complex have been halidized, or when the complex is within one layer and the salt in an adjacent layer. The two materials may even be distributed within different surfaces of the same layer.

Where light sensitivity is produced by partial halidization of the complexed silver salt (by generating light sensitive silver halide nuclei within the sheet by introduction of free halide ions), catalytic proximity is inherently produced by the halidization.

The nature of the binder system is not critical to the functionality of the present invention. Essentially any resinous material, natural or synthetic, thermoplastic or thermosetting, may be used as the binder. Such diverse materials as polyesters, polyamides, polyolefins, acrylates, epoxides, phenoxy resins, poly-vinyl resins (acetate, butyrate, vinyl alcohol, ethylcellulose), polycarbonate, silanes, siloxanes, polyvinylpyrollidone, gelatin, gum arabic or mixtures thereof may be used. Only in photothermographic constructions are even transparency or translucent properties necessary in the resin. Although no resins prevent the present system from working, it has been noted that epoxy resins do have a deleterious effect upon the quality of performance.

The preferred binders would be soluble in either aqueous or non-aqueous (e.g., organic) solvents. Such binders as gelatin and polyvinyl alcohol are generally preferred.

The reducing agent necessarily used in the construction of the thermographic or photothermographic constructions of this invention may be any reducing agent for silver ion. These are well known in the dry silver and photographic art.

Certain characteristics of the systems formed with the complexes of this invention are noteworthy in their superiority over prior art dry silver systems. Especially in two-trip sheets (that is, sheets having been constructed with the complex supplied in one layer and the halogen or halogen liberator supplied from an adjacent layer) a finer grain image having improved resolution results from the complexes of this invention. The final image is surprisingly found not to be in the layer originally containing the silver complex, but rather most of the image silver is found in the surface of the layer containing available halide or at the interface of the two layers. As much as 95% of the image silver is found in this area rather than in the layer originally containing the complex. Because the image is contained in such a thin region of the sheet (the surface of the halide supplying layer and the interface between the two layers) the grains tend to be highly resolved and fine.

The following examples will further illustrate the practice of the present invention.

EXAMPLE 1

A silver complex in a coatable binder was prepared by adding 0.85 g (0.005 moles) $AgNO_3$ to 1.25 g phenyl methyl sulfide ($\beta=5.0$) in 5 g of methanol. To this was added 15 g of a Gantrez® ES-435 isopropanol solution (Gantrez® resins are alkyl monoesters of poly(methylvinyl ether/maleic acid) produced by General Aniline and Film Corp.) and the flask was placed in an ultransonic vibrator for 5 minutes. The solution was then filtered and coated (5 mils wet) on a 4 mil thick polyester film and dried 5 minutes at 175° F. This was then overcoated (3 mils wet) with 20 g (16% by volume solids) of the above Gantrez® solution additionally containing 2.0 g AO-80 developer ($\alpha^2$, $\alpha^6$-bis(6 hydroxy-m-tolyl)mesitol), 1.5 g phthalic acid, 0.1 g TCPAN (tetrachlorophthalic anhydride), and 0.2 ml of 0.5 M $HgBr_2$ in methanol. The article was then dried for 5 minutes at 175° F. The article was then exposed through a test negative by a carbon arc and heat developed for 40 seconds at 280° F. An image with a Dmin of 0.13 and Dmax of 0.74 resulted.

EXAMPLE 2

A photothermographic sheet was constructed by first dissolving 16.9 G $AgNO_3$ (0.1 moles) in 50 ml of distilled water and adding 13.5 ml (0.204 moles) $NH_4OH$. This solution was concentrated and cooled, the white precipitate dried and stored in the absence of light.

A second source of this complex was obtained by dissolving 16.9 g Ag $NO_3$ in 50 ml distilled water and adding 75 aqueous solution containing 22.4 g $(NH_4)_2CO_3$ (0.20 moles). A white precipitate formed which subsequently redissolved. This redissolved solution was filtered, concentrated, then cooled, the resulting white precipitate filtered and washed with a small amount of acetone, and then dried.

1.2 grams of the $Ag(NH_3)_2NO_3$ complex ($\beta\cong7.2$) from each of the above preparations were dissolved in separate 15 ml solutions of isopropanol-water (40/60) containing 3% by weight polyvinyl alcohol. This material was coated on 4 mil polyester film (3 mils wet) and dried for 7 minutes at 180° F. Each coated sheet was cut into two pieces. One half of each coated sheet was top-coated (3 mils wet) with a 50% solution of Gantrez® ES-435 in isopropanol diluted with one part of methanol and one part 1,1,2 trichloroethane additionally containing 0.5 ml of 0.5 M $HgBr_2$ and 0.5 g hydroquinone per 15 grams of resin solution. Topcoat was dried for 5 minutes at 180° F. Sample was exposed through a negative on a carbon arc for 5 seconds and heat developed at 260° F. for 3–5 seconds. The remaining one-half of each first coated material was overcoated 3 mils thick (wet) with the previously described Gantrez® ES-435 solution containing 2.0 g developer (antioxidant-80), 1.5 g phthalic acid, 0.2 g tetrachlorophthalic anhydride (TCPAN) and 0.5 ml of 0.5 molar $HgBr_2$ in methanol per 20 g of Gantrez® resin solution. The coated material was dried at 180° F. for six minutes. Samples of each material were exposed through a 0–4 optical density wedge and heat developed for 15 seconds at 260° F. The sample had a yellow-tan background with a good black image. The final images from each of the different first coated sheets were identical indicating $Ag(NH_3)_2NO_3$ formed by either described method may be used.

EXAMPLE 3

0.99 g succinimide ($\beta\cong9.4$) and 0.852 g silver nitrate (0.005 moles ) were dissolved in 5 ml of deionized water along with 15 g of a 10% by weight aqueous solution of Cyanamer® P-26 (an acrylamide copolymer made by American Cyanamide Co.). After mixing, 0.1 g of 5-sulfosalicylic acid was added and the solution coated (4 mils wet) on subbed polyester. The coating was dried at 180° F. for 8 minutes. This was overcoated with a solution of 0.4 g hydroquinone and 0.3 ml of 0.5 M $HgBr_2$ in 20 g of the above 10% Cyanamer® P-26 resin solution (3 mils wet) and dried at 160° F. for 10 minutes.

A sample was exposed through a negative by a carbon arc and developed for 15 seconds at 260° F. An image with a Dmin of 0.11 and Dmax of 1.7 resulted.

In this example and the following two examples, the photographic silver halide emulsion provided the light sensitive salts which, upon formation of a latent image therein after exposure to light, are catalytic to the reduction of the silver salt complexes. The silver salts therefore acted as would directly halidized complex, or a complex mixed with light sensistive salt. All that is needed for light sensitive emulsions in the practice of this invention is for silver halide to be in catalytic proximity to the silver complex.

The fact that the silver image was provided by the silver salt complex was substantiated by making the above article without the silver salt complex. This article was then light exposed and heat treated with no visible image being formed. This proves that the silver complex is essential to the generation of the visible image.

EXAMPLE 4

A solution of 0.99 g succinimide ($\beta\cong9.4$) and 0.852 g silver nitrate in 5 ml of deionized water was added to 15 g of a 10% by weight aqueous solution of Cyanamer® P-26. To this solution was added 0.1 g of 5-sulfosalicylic acid and 0.4 g hydroquinone. This solution was then coated 5 mils thick (wet) over a commercial silver halide emulsion (Eastman Kodak SO-192) and dried at 160° F. for 6 minutes. The film was then exposed to 10,000 meter-candle-seconds in an Eastman Kodak 101 sensitometer (lamp temperature 6000° K.) and heat developed for 4 seconds at 260° F. A Dmin of 0.4 and a Dmax of 1.1 were measured.

EXAMPLE 5

Example 4 was repeated except that 0.05 g of mercuric acetate was added to the coating and the development time was increased to 15 seconds. The properties of the film determined were Dmin 0.5, Dmax 2.5, speed $1\times10^{-3}$ ASA, and gamma 0.92.

EXAMPLE 6

Example 5 was repeated except that the commercial emulsion used was 3M Co. Type C microfilm. After development, the film was fixed in Kodak F-5 fix (of composition described on page 1760 Lange Handbook of Chemistry, Ninth Ed.). The determined properties were Dmin 0.11, Dmax 1.2, speed 0.1 ASA and gamma 0.75.

EXAMPLE 7

A coordinated silver salt composition was formulated as follows:

12 g of a 50/50 mixture of methanol and 1,1,2-trichloroethane was mixed with 0.75 g imidazole, 0.75 g silver nitrate and 0.19 g phthalic acid by agitation in an ultrasonic bath.

To this composition was added 12 g of a 25/75 mixture of Gantrez® ES-335-1 and isopropanol. Agitation was used to mix the final composition. This final composition was coated with a 2 mil coating orifice onto a 3 mil $TiO_2$ filled polyester and dried for 7 minutes at 180° F.

A top coat solution was formulated as follows:

0.25 g TCPAN, 2.0 g phthalic acid, and 2.0 g AO-80 Developer were added to 25 g of a 75/10/10/5 mixture of methanol, butanol, EASP and EASB resins. To this were further added 0.045 g mercuric bromide in 2 cc of methanol and 0.01 g mercuric acetate in 1 cc of methanol. The total solution was thoroughly mixed by agitation.

The top-coat solution was coated on the already coated film using a 2¼ mil coating orifice and dried for 5 minutes at 180° F.

Samples of this film were exposed to a carbon arc light source through a 0–4 continuous tone wedge and heat developed at 260° F. in a fluorochemical bath for 40 seconds. The images produced were found to have a Dmin of 0.10 and Dmax of 1.26.

EXAMPLE 8

1.2 g 2-ethylimidazole, 1.0 g silver nitrate and 0.3 g tetrachlorophthalicanhydride (TCPAN) were added to 5.0 g of a 50/50 mixture of acetone and methanol, then agitated until dissolved. This solution was diluted to a total weight of 25.0 g with a 16% solids concentration resin solution of Gantrez® 435 with equal amounts of isopropanol and methanol. The resulting solution was coated at 2¾ mils wet over the base and dried for six minutes at 180° F.

A second coating solution was made as follows:

1.5 g phthalic acid (toner), 1.5 g AO-80 antioxidant (developer), 0.2 g TCPAN, 0.15 g $CaBr_2$ solution (0.5 M in methanol), two drops HBr (48% by weight in water), 0.9 g 0.25 M mercuric acetate solution in methanol, and Lith 454 sensitizing dye were added to 5 g of an equal weight mixture of acetone and methanol. The mixture was agitated until materials refused to dissolve further. This was then diluted to a total weight of 25.0 g with a 15% by weight cellulose acetate propionate (CAP) solution (15% CAP, 10% methanol, 38% acetone, 37% methyl ethyl ketone), and all materials were dissolved. This solution was then coated 3 mils wet over the previous coating and dried for 5 minutes at 180° F.

The resulting film was imaged and exposed by a 10,000 meter-candle-seconds exposure (light temperature was 6000° K.) to a 0–4 continuous wedge and then thermally processed for 60 seconds at 260° F. in a fluorocarbon bath. A Dmax of 1.80 and a Dmin of 0.09 were obtained. The film exhibited a speed of $3.2\times10^{-2}$ ASA at 0.10 density units above base and fog.

When an identical film was similarly exposed and developed for 300 seconds at the same temperature, a Dmax of 2.5 and Dmin of 0.10 and a speed of $4.5\times10^{-2}$ at 0.10 density units above base and fog were obtained. This evidences the fact that the film exhibits wide development latitude with excellent suppression of the Dmin.

It was surprisingly found that the resultant silver image formed in this construction was found in the overcoat layer and not in the layer originally containing the silver complex. The construction was also found to exhibit useful sensitivity to an electron beam.

EXAMPLE 9

1.2 g ethylimidazole, 0.75 g silver nitrate, 0.17 g zinc nitrate, 0.17 g mercuric nitrate, 0.6 g TCPAN, 0.2 g phthalic acid, 1.0 g AO-80, 0.10 g of a 0.5 M $HgBr_2$ aqueous solution, and Lith 454 sensitizing dye were added to 5 g of an equal weight mixture of acetone and methanol. This was diluted as in the previous example to dissolve all materials. The solution was then coated at 3½ mils wet over a 4 mil polyester film base and imaged as in the previous example. Development was for 45 seconds at 280° F. in a fluorocarbon bath. A Dmax of 1.90 and a Dmin of 0.14 were obtained.

EXAMPLE 10

This example indicates the usefulness of emulsions according to the present invention in direct positive systems.

1.2 g ethylimidazole, 0.75 silver nitrate, 0.15 g zinc nitrate, 0.15 mercuric nitrate, 0.60 g TCPAN, one drop of a 48% by weight solution in HBr in water, 0.2 g phthalic acid, and Lith 454 sensitizing dye were added to 5.0 g of an equal weight solution of acetone and methanol, diluted, coated and exposed as in the previous two examples. The film was developed for 100 seconds at 280° F. in a fluorocarbon bath. A sepia direct positive image was formed having a Dmax of 0.88 and a Dmin of 0.45. To a blue filter, the Dmax measured 1.72 with a Dmin of 0.56.

EXAMPLE 11

A film was prepared, exposed and developed as in the previous example except that 0.2 g of cadmium nitrate replaced the mercuric nitrate. This yielded a Dmax of 1.36 and Dmin of 0.95 to a neutral filter and a Dmax of 3.30 and Dmin of 1.35 to a blue filter.

EXAMPLE 12

A first coating solution of 0.5 g 1-methylimidazole and 0.5 g silver nitrate in 25 g of a polyvinyl alcohol-water solution was coated at 4 mils wet on a 4-mil polyester film base and dried for 15 minutes at 170° F.

A second coating solution of 20% solids content butyrate (5%) and propionate (15%) resins in methanol and 0.2 g TCPAN, 3.0 g phthalic acid, 3.0 g AO-80 developer, 0.8 g $NH_4Br$ of a 4% by weight solution in methanol, and Lith 454 sensitizing dye was agitated until all solids dissolved, and coated at $1\frac{1}{2}$ mils wet over the first coating, then dried for six minutes at 170° F. The film was given a tungsten exposure from a lietz overhead projector of 5 seconds and then developed for 60 seconds at 260° F. in a fluorocarbon bath. An apparent Dmax of 1.4 and Dmin of 1.12 were obtained. However, when the top layer was washed off with methyl ethyl ketone, the water-soluble layer exhibited a direct positive of Dmax 0.99 and a Dmin of 0.55. The alcohol soluble top layer had a negative image, which by substraction, exhibited a Dmax of 0.90 and a Dmin of 0.13.

It is apparent that the appropriate selection of resins would yield a negative-positive strippable system.

EXAMPLE 13

1.2 g of 2 ethylimidazole and 1.0 g of silver nitrate were added to 6.0 g of a 50/50 mixture of acetone and methanol. Three drops of a 0.5 molar $HgBr_2$ solution in methanol was added. This solution was then imbibed in plain paper and dried. The dried paper was imaged through a negative and contacted with a sheet imbibed with hydroquinone. The two sheets in contact were heated on a curved block at 260° F. for 5 seconds. Upon separation of the sheets a good readable image was observed on the silver complex imbibed sheet.

This example shows that the binder is not essential to the activity of the complex in thermographic or photothermographic sheets.

In the above examples EASP resin is an alcohol soluble propionate ester of cellulose containing sufficient hydroxyl groups to render it soluble in alcohol. It is manufactured by Eastman Kodak Co. EASB is an alcohol soluble butyrate ester of cellulose similar to EASP. Lith 454 sensitizing dye is a compound of the formula:

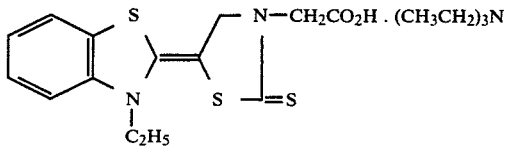

EXAMPLE 14

0.15 g silver sulfate and 0.4 g 2-ethylimidazole was dissolved in an 8% by weight solids solution of Gantrez ® 235 in 75/25 methanol/isopropanol, the solution was coated 5 mils wet thickness on polyester and dried for 6 minutes at 75° C.

A second solution of 1.5 g phthalic acid, 0.2 g TCPAN and 2 g AO-80 in 10 ml of 50/50 methanol/isopropanol solution containing 16% by weight Gantrez ® 235 was formulated and 1 ml of 0.25 M mercuric acetate and 6 drops of 4.8 weight percent hydrobromic acid in methanol were added. This solution was coated at 4 mils wet thickness over the first coating and dried for 5 minutes at 75° C.

This film was exposed through a photographic negative by a mercury lamp for 1 minute (about $10^5$ lumens) then heat developed by about 125° F. for 30 seconds. A readable image with 0.23 Dmin and 0.78 Dmax was obtained.

EXAMPLE 15

The above example was repeated using 0.3 g silver nitrite and 0.6 g 2-ethylimidazole in the first layer. Upon identical exposure, except through a microfilm negative, and identical heat development, a readable image was produced.

EXAMPLE 16

0.13 of silver cyanide and 0.3 g 2-ethylimidazole were dissolved in 10 ml of methanol and 10 ml of a 12% by weight solution of butvar resin in 68/20 methanol/butyl alcohol, coated 5 mils wet on polyester and dried at 75° C. for 5 minutes.

A second solution of 0.6 g hydroquinone and 0.08 g mercuric bromide in 10 ml methanol and 16% by weight Gantrez ® 235 in 50/50 methanol-butanol was coated 4 mils wet over the first coating and dried at room temperature. After exposure and heat development identical to that of Example 14, a Dmin of 0.3 and Dmax of 0.9 was produced.

EXAMPLE 17

Example 16 was repeated using 0.13 g silver cyanate in place of the silver cyanide and substantially similar results were obtained.

EXAMPLE 18

0.12 g silver phosphate and 0.6 g N-methyl imidazole were dissolved in 15 g distilled water with 5 g methanol and 1 g polyvinylpyrrolidone, then coated 5 mils wet onto polyester base and dried at 75° C. for 5 minutes. A second coating identical to that of Example 1 was applied 5 mils wet thickness and dried. Upon exposure and development identical to that of Example 15, a readable image was produced.

EXAMPLE 19

A 1 M solution of silver carbonate 1-methyl imidazole complex in water was mixed with 5 ml of a 5% by weight polyvinyl alcohol in water solution, coated 4 mils wet thickness on polyester base and dried 5 minutes at 60° C.

A second solution of 5 ml methyl ethyl ketone 5 ml methanol, 0.1 g AO-80, 0.02 g phthalazone and 1 ml of 1% mercuric bromide in methanol was coated over the first coating layer, then dried for 10 minutes at room temperature. After a 15 second exposure through a microfilm negative to a mercury lamp and heat development at 125° C. for 30 seconds, a readable image was produced.

EXAMPLE 20

0.75 g silver nitrate and 0.06 g 2-ethylimidazole in 11.25 g methanol was mixed with 12 g of a 25% by weight solution of Grantrez ® ES-335-1 in isopropanol, coated 2 mils wet thickness over polyester and dried for 6 minutes at 70° C.

Over this was coated $2\frac{1}{4}$ mils wet thickness a solution of 12.8 g methanol, 0.285 g triphenylmethyl bromide, 1 ml of 3.19% mercuric acetate in methanol, 4.5 g AO-80, 6.0 g phthalic acid, 0.5 g TCPAN, and 72 g of a resin solution comprising 80% by weight methanol, 10% butanol, 10% EASB (above defined) and 5% EASP which was dried at 80° C. for 5 minutes.

After 25 seconds exposure to a carbon arc through a photographic negative and development at 125° C. an image having 0.05 Dmin, 1.4 Dmax and a gamma of 1.49 was produced.

EXAMPLE 21

Example 20 was repeated except that 0.83 g silver pyruvate was used in place of silver nitrate. Identical exposure and development generated an image of 0.05 Dmin and 1.53 Dmax.

EXAMPLE 22

Example 20 was repeated except that 1.00 g of the silver salt of trifluoroacetic acid was used in place of the silver nitrate. After identical exposure and development an image with 0.07 Dmin, 1.48 Dmax and gamma of 1.49 was produced.

EXAMPLE 23

Example 20 was repeated except that 0.74 g silver acetate was used in place of the silver nitrate and the Gantrez® resin was replaced with 12.0 g of a 12% by weight solution of butvar (polyvinyl butyral) resin in 68/20 methanol/butanol. After identical exposure and development, an image having 0.05 Dmin, 1.53 Dmax and gamma of 1.35 was produced.

EXAMPLE 24

Example 23 was repeated except that 1.11 g of silver 2-ethylhexanoate was used in place of silver acetate. The generated image had Dmin 0.06, Dmax 1.53 and a gamma of 1.46.

EXAMPLE 25

Example 23 was repeated using 0.755 g silver citrate in place of the silver acetate. The generated image had Dmin 0.14, Dmax 1.42 and a gamma of 0.84.

EXAMPLE 26

Example 23 was repeated using 1.725 g of silver stearate in place of the silver acetate. The generated image had Dmin 0.63, Dmax 1.41 and a gamma of 0.38.

Although the complexed silver salts of this invention are novel materials in photothermographic systems, it has been found that structures, additives, and processes useful with silver organic salt photothermographic materials are useful with the technology of this invention. For example, toning agents and reducing agents disclosed in U.S. Pat. Nos. 3,392,020; 3,446,648; 3,667,958; 3,667,959; 3,672,904; 3,679,426; 3,751,249; 3,751,252; 3,751,255; 3,801,321 and British Pat. Nos. 1,163,187; 3,782,941 and 3,794,488 are useful in the practice of the present invention. Sensitizers and sensitizing dyes as disclosed in U.S. Pat. Nos. 3,679,422; 3,666,477; 3,761,279 and 3,719,495 are also useful, as are such materials described as image amplifiers (U.S. Pat. No. 3,708,304), color couplers (U.S. Pat. No. 3,531,286), development inhibitor releasing compounds (U.S. Pat. No. 3,700,457), decolorizable light absorbers (3,745,009), mercury compounds (U.S. Pat. No. 3,589,903), etc. Processes and structures described in U.S. Pat. Nos. 3,748,137; 3,761,270; 3,764,328; 3,764,329; 3,769,019; 3,589,901; 3,152,904 U.S. Pat. No. (Re. 26,719); U.S. Pat. Nos. 3,607,282; 3,685,993; 3,679,414; 3,218,166 and 3,756,829 are also contemplated in the practice of the present invention.

The use of the complexes of the present invention in the construction of thermographic or dry silver imaging materials provides a number of advantages over prior technology. One improvement is the fact that these complexes may be coated as a solution unlike the silver salts used in photothermographic materials which must be milled into the sheet construction. In fact this is a simple test for complex formation, as addition of a complexing agent, N-methyl imidazole, for example, causes the silver salts to dissolve in most solvents. This simplifies production of thermographic sheets.

Thermographic sheets may be tailored to be suitable for use with known developers. The greater the stability of any complex, the greater must be the strength of the developer which is to reduce the silver ion to metallic silver. Given the strength of any developer, a complex could be tailored to have the appropriate stability for that developer so that a constant developing time could be used for different combinations of complexes and developers.

Furthermore, some insoluble silver salts may be used in the practice of this invention if the ligand is soluble.

In examples using Lith 454 dye sensitizer, 5 ml of 0.8 g dye/100ml N-methyl pyrrolidone was added.

What we claim is:

1. A thermographic recording medium comprising at least one layer comprising a binder, a reducing agent, and at least one silver salt complexed by at least one coordinating compound having a gross stability constant between 4.50 and 10.00 wherein at least 90% of all silver salt, excluding silver halide, within said layer is in the form of a silver salt complex with said at least one coordinating compound.

2. The thermographic recording medium of claim 1 wherein at least 95% of all silver salt excluding silver halide within said layer is in the form of a complex with said at least one coordinating compound.

3. The thermographic recording medium of claim 1 wherein substantially all silver salt within said layer is in the form of a complex with said at least one coordinating compound.

4. The thermographic recording medium of claim 1 wherein the layer is coated onto a base.

5. The thermographic recording medium of claim 1 wherein the silver salt is an organic silver salt.

6. The thermographic recording medium of claim 1 wherein the silver salt is an inorganic silver salt.

7. The thermographic recording medium of claim 1 wherein the coordinating compound is a compound having an imidazole group capable of sequestering silver ions.

8. A photothermographic recording medium comprising at least one layer comprising a binder, a reducing agent, and at least one silver salt complexed by at least one coordinating compound having a gross stability constant between 4.50 and 10.00, wherein at least 50% of all silver in said layer is in the form of a silver salt complex, wherein at least 90% of all silver salts excluding silver halide is in the form of a silver salt complex with said at least one coordinating compound, and wherein 0.25–50.0 mole percent of silver halide/total silver in said medium is present in catalytic proximity to said complexed silver salt.

9. The photothermographic recording medium of claim 8 wherein the complexed silver salt is in physical contact with silver halide.

10. The photothermographic recording medium of claim 8 wherein at least 95% of all silver salt within said layer is in the form of a complex with said at least one coordinating compound.

11. The photothermographic recording medium of claim 8 wherein substantially all of silver salt within said layer is in the form of a complex with said at least one coordinating compound.

12. The photothermographic recording medium of claim 8 wherein the layer is coated onto a base.

13. The photothermographic recording medium of claim 8 wherein the at least one coordinating compound is a compound having an imidazole group capable of sequestering silver ions.

14. The photothermographic recording medium of claim 8 wherein 1–15 mole percent of silver halide/total silver in said medium is in catalytic proximity to said complexed silver salt.

* * * * *